US006406410B1

(12) United States Patent
Lochbaum

(10) Patent No.: US 6,406,410 B1
(45) Date of Patent: Jun. 18, 2002

(54) BASE FOR EXERCISE

(76) Inventor: Kenneth Lochbaum, 3002 E. 38th St., Erie, PA (US) 16510-2924

( * ) Notice: Subject to any disclaimer, the term of this patent is extended or adjusted under 35 U.S.C. 154(b) by 0 days.

(21) Appl. No.: 09/584,614

(22) Filed: May 31, 2000

Related U.S. Application Data

(60) Provisional application No. 60/137,300, filed on Jun. 3, 1999.

(51) Int. Cl.[7] ..... A63B 22/00
(52) U.S. Cl. ..... 482/111; 482/148; 482/91
(58) Field of Search ..... 248/346.01, 346.03; 482/126, 111, 148, 132, 130, 140, 91

(56) References Cited

U.S. PATENT DOCUMENTS

| | | | | |
|---|---|---|---|---|
| 306,874 A | * | 10/1884 | Thatcher | 248/346.01 |
| 1,131,399 A | * | 3/1915 | McGinley | 248/346.01 |
| 2,875,528 A | | 3/1959 | Garate | |
| 3,415,475 A | | 12/1968 | Goodman | |
| 3,427,002 A | | 2/1969 | Ward | |
| 3,807,727 A | | 4/1974 | Ferguson | |
| 3,861,675 A | | 1/1975 | Hopper | |
| 3,913,970 A | | 10/1975 | Jardin, et al. | |
| 4,145,044 A | | 3/1979 | Wilson et al. | |
| 4,170,799 A | | 10/1979 | Ratelbard | |
| 4,247,096 A | | 1/1981 | Schmitt | |
| 4,332,217 A | | 6/1982 | Davis | |
| 4,411,422 A | | 10/1983 | Solloway | |
| 4,576,376 A | | 3/1986 | Miller | |
| 4,645,392 A | * | 2/1987 | Takaguchi | 248/346.01 |
| 4,712,788 A | | 12/1987 | Gaudreau, Jr. | |
| 4,721,300 A | | 1/1988 | Guzman | |
| 4,759,544 A | | 7/1988 | Diaz | |
| 4,768,744 A | | 9/1988 | Leeds et al. | |
| 4,784,385 A | | 11/1988 | D'Angelo | |
| 4,838,545 A | | 6/1989 | Wilson | |
| 4,918,766 A | | 4/1990 | Leonaggeo, Jr. | |
| 5,013,034 A | | 5/1991 | March et al. | |
| 5,033,735 A | | 7/1991 | Erickson | |
| 5,098,085 A | | 3/1992 | Abboudi et al. | |
| 5,100,130 A | | 3/1992 | Shoebrooks | 482/121 |
| 5,110,130 A | | 5/1992 | Aulicino | 273/153 |
| 5,217,420 A | | 6/1993 | Abboudi et al. | 482/70 |
| 5,219,317 A | | 6/1993 | Beasley | 482/111 |
| 5,234,391 A | | 8/1993 | Shasek et al. | 482/111 |
| 5,242,352 A | | 9/1993 | Elliott | 482/111 |
| 5,295,929 A | | 3/1994 | Weisz | 462/54 |
| 5,372,564 A | | 12/1994 | Spirito | 482/112 |
| 5,417,636 A | | 5/1995 | Havens | 482/145 |
| 5,458,549 A | | 10/1995 | Obery | 482/23 |

(List continued on next page.)

FOREIGN PATENT DOCUMENTS

| | | | | |
|---|---|---|---|---|
| WO | WO 94 24440 | * | 4/1994 | 248/346.01 |

*Primary Examiner*—Jerome Donnelly
(74) *Attorney, Agent, or Firm*—Wayne L. Lovercheck

(57) ABSTRACT

A base member for an exercise device made up of a single member or flat plate. A single tubular member or an array of tubular members may be supported on a plate and fixed to it. The tubular member has slots in its sides extending from the top to the bottom. A cylindrical receptor having radially extending lugs may be inserted in the tubular member with the lugs slidably received in the slots. When the lugs pass the lower end of the tube, the receptor can be rotated bringing the lugs under the lower end of the tubular member thereby locking the receptor in the tubular member. A pin through the flange member into the channel can provide a permanent lock. The flange member provides space to hold material or a space for a seal. An exercise connector post device can be received in the receptor and fins on the inside periphery of the receptor engage fins holding the post against rotation. The receptor also has a series of vertical and horizontal slots which the post can engage or be fastened to. The fins and slots also hold the post from moving sideways or rotating. Channels may be used to support single base members in desired positions. The channels allow the single base members to slide along the channel length to adjust their position to the size of the exercise device or the exercising person.

23 Claims, 6 Drawing Sheets

U.S. PATENT DOCUMENTS

| | | | | | |
|---|---|---|---|---|---|
| 5,533,950 | A | | 7/1996 | Lochbaum | 482/51 |
| 5,558,604 | A | | 9/1996 | Hopkins | 482/54 |
| 5,611,763 | A | | 3/1997 | Lochbaum | 482/111 |
| 5,643,156 | A | | 7/1997 | Lochbaum | 482/111 |
| 5,665,040 | A | * | 9/1997 | Ho | 482/126 |
| 5,769,763 | A | | 6/1998 | Lochbaum | 482/111 |
| 5,795,273 | A | | 8/1998 | Lochbaum | 482/111 |
| 5,813,952 | A | | 9/1998 | Lochbaum | 422/111 |
| 5,865,710 | A | | 2/1999 | Lochbaum | 482/52 |
| 5,913,754 | A | | 6/1999 | Lochbaum | 482/111 |

* cited by examiner

BASE FOR EXERCISE

CROSS REFERENCE TO RELATED APPLICATIONS

This application claims the benefit of U.S. Provisional Application Serial No. 60/137,300 filed Jun. 3, 1999.

STATEMENT REGARDING FEDERALLY SPONSORED RESEARCH OR DEVELOPMENT

Not Applicable.

BACKGROUND OF THE INVENTION

The exercise base disclosed herein is an improvement over the aquatic exercise base disclosed in U.S. Pat. No. 5,533,450 issued on Jul. 9, 1996, to Kenneth Lochbaum who is the inventor of the present application. The '450 Patent discloses a base to be attached to the bottom of a body of water. The base may be made up of plastic tubes attached together with their lower ends disposed in a first plane and their upper ends disposed in a second plane.

Applicant is aware of the,following U.S. Pat. No. 2,875,528 to Garate; U.S. Pat. No. 3,415,475 to Goodman; U.S. Pat. No. 3,861,675 to Hopper; U.S. Pat. No. 4,145,044 to Wilson; U.S. Pat. No. 4,170,799 to Ratelband; U.S. Pat. No. 4,247,096 to Schmitt; U.S. Pat. No. 4,759,544 to Diaz; U.S. Pat. No. 4,784,385 to D'Angelo; U.S. Pat. No. 5,219,317 to Beasley; U.S. Pat. No. 5,242,352 to Elliott; and, U.S. Pat. No. 5,372,564 to Spirito.

SUMMARY OF THE INVENTION

The present invention includes a base for use in both aquatic and other exercise with plastic tubes that rest on a plate by which they are held in spaced relation to each other. Each tube has vertically extending slots and outwardly extending channels, which overlay the slots. The channels are integrally attached to the tubes. Receptors having lugs that can be inserted in the slots of tubes with the lugs extending into the slot and sliding down through the slots and channels through the plate. The receptors can then be rotated bringing the lugs under the plate or into a horizontally extending recess in the support and into contact with a stop member to prevent the receptor from being removed from the cylindrical member.

Channel members comprising three closed sides, and a partly open side may be used to secure an individual base section in an operative position on a bottom or side of a pool or on the ceiling thereover. The channel provides a means for adjusting the position of the individual base section by sliding it along the length of the channel to a desired position.

A wrench with a long handle is provided for use in pools containing water. The wrench can be operated from above the top of the water. The wrench has a non-circular socket to receive a non-circular member on the receptor so that the receptor can be rotated by an operator above the water bringing the lugs on the receptor back into the vertical slots in the tubular member so that an operator from a position above the top surface of the water can remove the receptor from the base under water.

It is an object of the. present invention to provide a base for aquatic exercise to be used with a removably attachable receptor to support exercise equipment.

It is another object of the invention to provide a removal tool to attach and detach receptors at desired positions.

It is another object of the present invention to provide a base for use in exercise, both aquatic and other exercise equipment. In addition to other applications, such as crowd control, signs, universal hold devices, and other applications.

It is another object of the present invention to provide an improved receptor for use with the base for aquatic exercise and ordinary exercise.

It is another object of the invention to provide a base for aquatic exercise, a removably attachable receptor and a tool to attach and detach receptors from the base that are simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
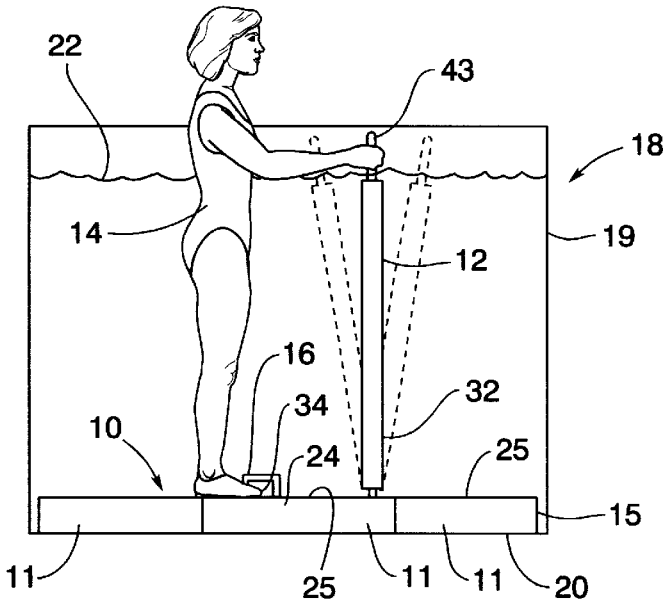
FIG. 1 is a front view of the exercising device supported on the base with the front side removed.
Figure 2:
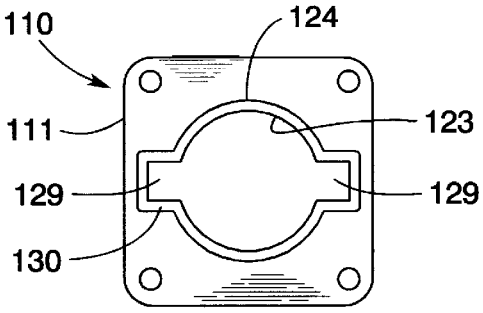
FIG. 2 is a top view of another embodiment of a base section according to the invention.
Figure 3:
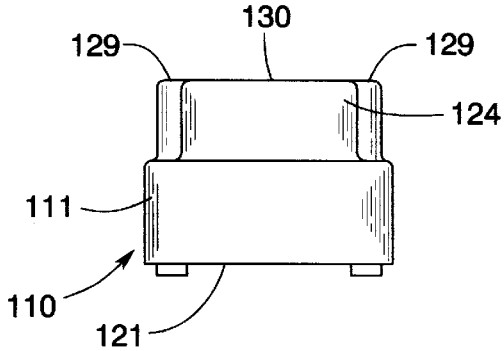
FIG. 3 is a front view of the base section shown in FIG. 2.
Figure 4:
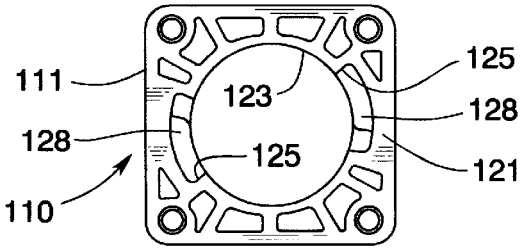
FIG. 4 is a bottom view of the base section shown in FIGS. 2 and 3.

The base member disclosed herein is suitable for use for example, during exercises of various kinds and is especially suitable for use during aquatic exercise to support aquatic exercise devices and other uses.

Now with more particular reference to the drawings, FIGS. 1 and 6 through 10 show base member 10 for a container which may be filled water 18. Container 18 has side walls 19, bottom 20 and water top surface 22. Person 14 is shown standing on base member 10. Foot stabilizer 16 on base member 10 supports feet 34 of person 14. Exercising device 12 is attached to receptor 32 and has grip 43 on an upper end of exercising device 12.

Base member 10 is made up multiple base sections 11. Base sections 11 have plate 25 and relatively short sections of spaced tubular members 24. Base sections 11 each have downwardly extending flange 15 integrally attached thereto. Tubular members 24 each have lower end 27 attached to plate 25.

Figure 5:
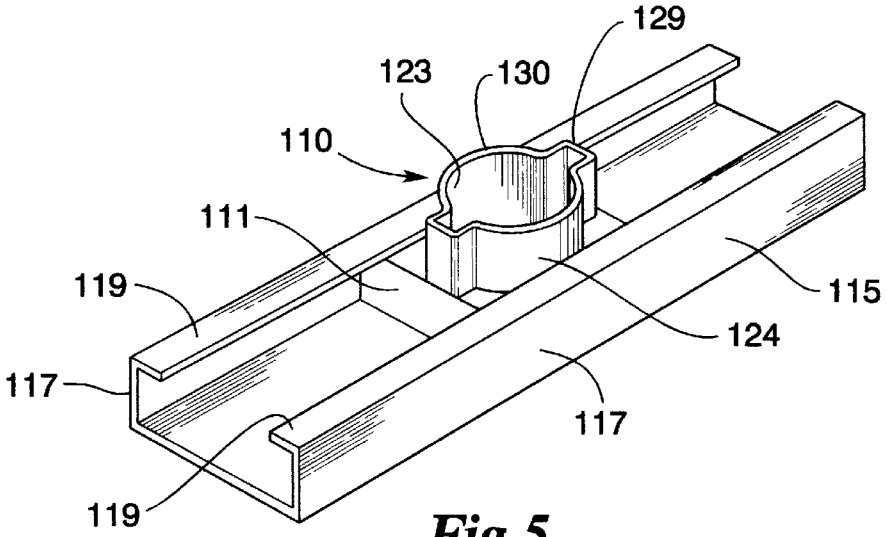
FIG. 5 is an isometric view of the base section shown in FIGS. 2–4 supported in a channel member.

FIGS. 2 through 5 show another embodiment of the invention wherein individual base member section 110 may be used as an individual base section 111 or individual base sections 111 may be used with channel 115 as shown in FIG. 5. Channel 115 may be used to secure individual base section 111 in an operative position, and provides a means for adjustment of the position of individual base section 111 by sliding it along the length of channel 115 to a desired position.

Individual base section 111 has a tubular member 124 having upper end 130. Each tubular member 124 has inner periphery 123 extending down through and to bottom surface 121 of individual base section 111. Vertical slots 129 are formed in tubular member 124 and extend through tubular members 124 from the top thereof to the bottom of individual base section 111. Horizontal slots 128 are formed in inner periphery 123 of tubular member 124. Tubular member 124 and base section 111 are integrally connected together and make up a single piece.

Laterally extending lugs 33 on receptor 32, FIGS. 11–15, will slide down vertical slots 129 to horizontal slots 128, where receptor 32 can be rotated moving laterally extending lugs 33 into horizontal slots 128 thereby preventing receptor 32 from being pulled up out of tubular member 124.

Base member 110 can be inserted in an end of channel 115 between flanges 117 with channel ends 119 overlying the edge of base section 111. Channel 115 can be attached to a floor, wall or ceiling by suitable fasteners.

Figure 6:
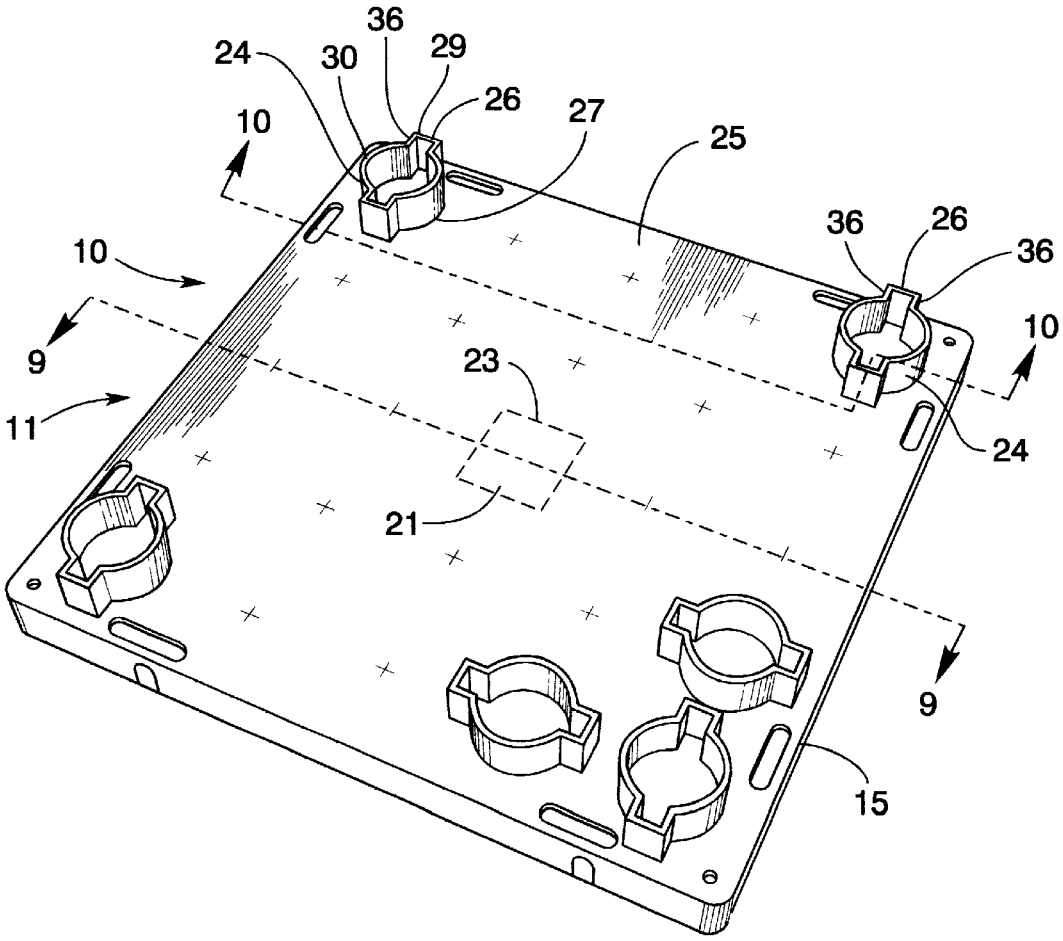
FIG. 6 is an isometric view of one section of the embodiment of the base section shown in FIG. 1.
Figure 7:
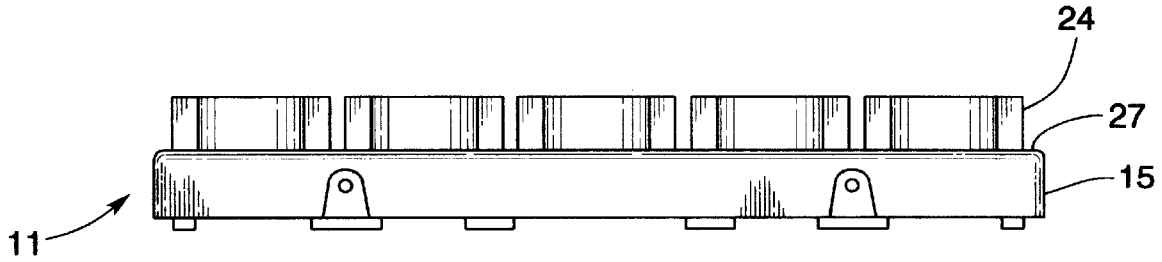
FIG. 7 is an end view of the base section shown in FIG. 6.

As shown in FIG. 6, central opening 21 can be made in plate 25 by breaking plate 25 along score lines 23. An individual base member section 110 can then be placed in central opening 21 in plate 25.

Figure 8:
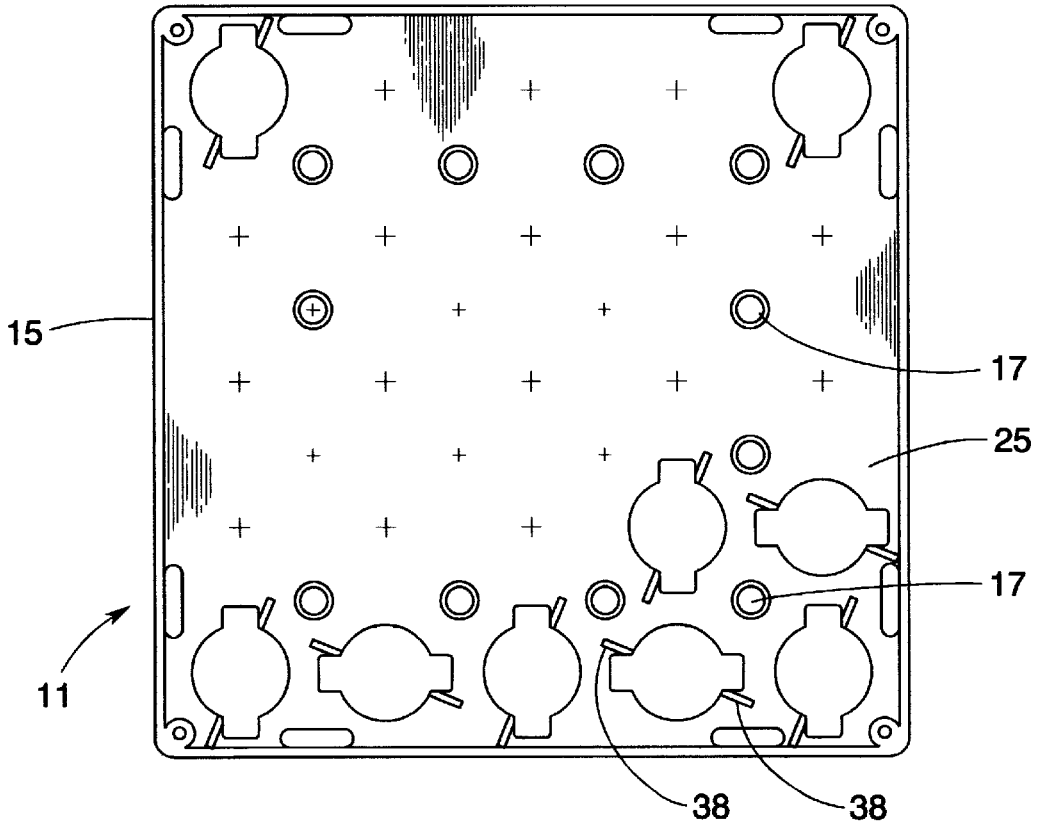
FIG. 8 is a bottom view of the base section shown in FIGS. 6–7.
Figure 9:
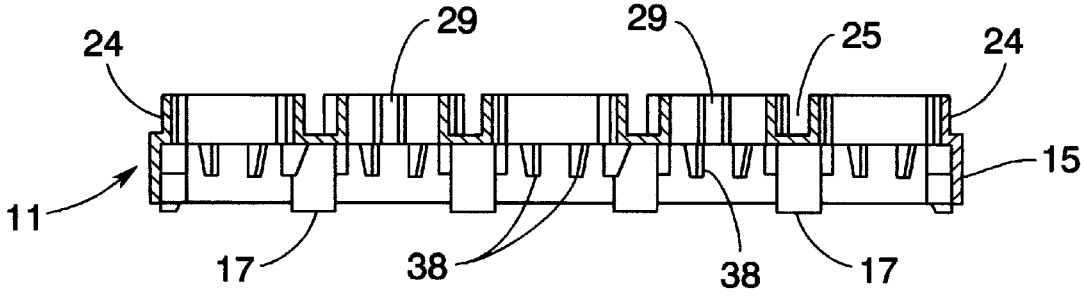
FIG. 9 is a cross sectional view of the base section taken on line 9—9 of FIG. 6.
Figure 10:
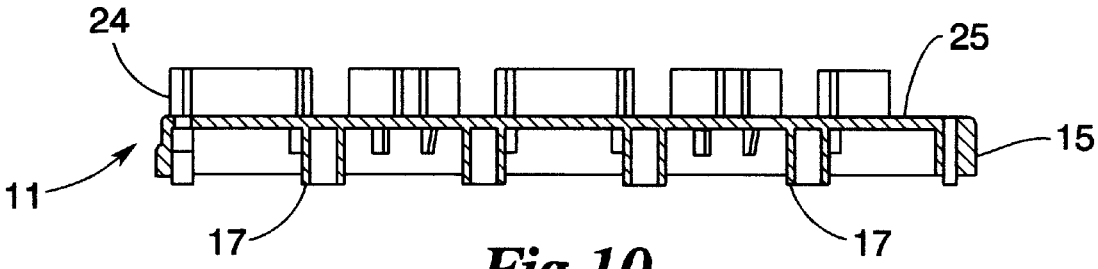
FIG. 10 is a cross sectional view taken on line 10—10 of FIG. 6.

As shown in FIGS. 8, 9 and 10, plate 25 has plate support tubes 17 fixed to it that rest on bottom 20 of container 18 or any suitable surface to support base member 10. Upper end 30, of each tubular member 24, is disposed in a common plane with upper end 30 of other tubular members 24. Each tubular member 24 has two diametrically spaced vertical slots 29. Vertical channel members 26 overlie vertical slots 29 extending from upper end 30 to lower end 27. Vertical channel members 26 have legs 36 integral with the sides of tubular members 24. Stop members 38 are fixed to the bottom of plate 25 and are engaged by laterally extending lugs 33 thereby limiting the rotation of receptor 32. Receptor 32 cannot be removed from tubular member 24 until receptor 32 is rotated to align laterally extending lugs 33 with vertical slots 28. Thus, person 14 cannot place or remove exercise device 12 unless laterally extending lug 33 is aligned with vertical slot 29.

FIGS. 11 through 17 show receptors 32 that can be used with base members 10 and 110. Receptor 32 has cylindrical body 31 and diametrically spaced, laterally extending lugs 33. Cylindrical body 31 has hexagonal flange 35 that can rest on upper end 30 of a tubular member 24 or upon upper end 130 of tubular member 124. Laterally extending lugs 33 can pass down through vertical slots 29, or horizontal slots 128 of the embodiment shown in FIGS. 2–5, and vertical channel member 26. When receptor 32 is placed in tubular member 24, shown in FIGS. 6–10 and when receptor 32 reaches the lower side of plate 25 and is rotated, laterally extending lugs 33 move under plate 25 at the lower end of tubular members 24 and contact stop members 38 to prevent receptors 32 from being pulled up from tubular members 24. Likewise when receptor 32 is placed into tubular member 124 shown in FIGS. 2–5 and as an assembly in FIGS. 16 and 17 and rotated, laterally extending lugs 33 move under horizontal slots 128 contacting vertical stop surfaces 125 to prevent receptors 32 from being pulled up from tubular members 124.

Figure 12:
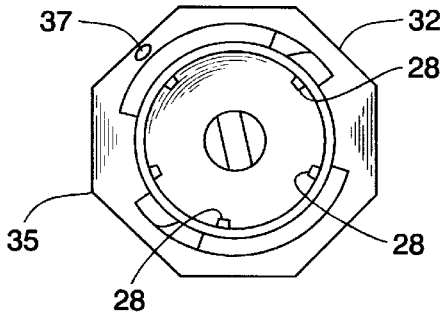
FIG. 12 is a top view of the receptor shown in FIG. 11.
Figure 13:
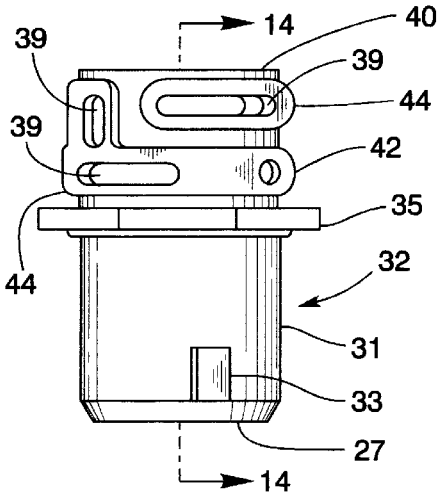
FIG. 13 is a side view of the receptor shown in FIG. 11.

As shown in FIG. 12, hole 37 is drilled in hexagonal flange 35 to allow a screw, pin or the like to protrude through hole 37 and into vertical slot 29,129 to prevent receptor 32 from being rotated. Thus providing a locking means to keep receptor 32 permanently together and in base member 10,110.

Figure 11:
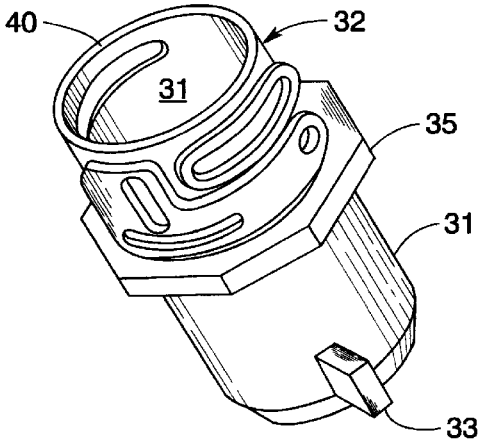
FIG. 11 is an isometric view of a receptor according to the invention.
Figure 14:
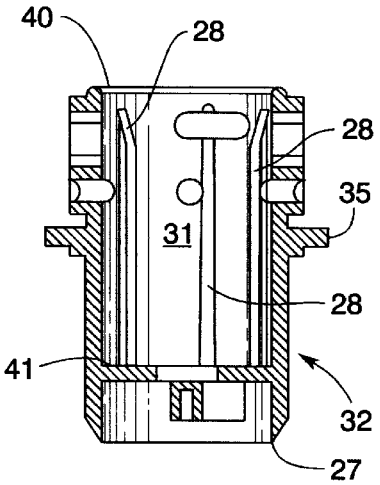
FIG. 14 is a cross sectional view taken on line 14—14 of FIG. 13.
Figure 15:
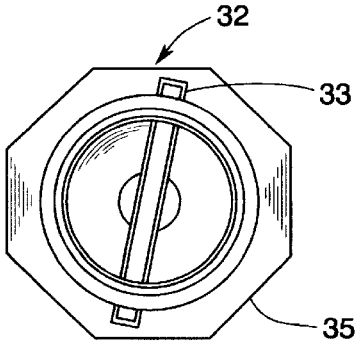
FIG. 15 is a bottom view of the receptor shown in FIG. 13.
Figure 16:
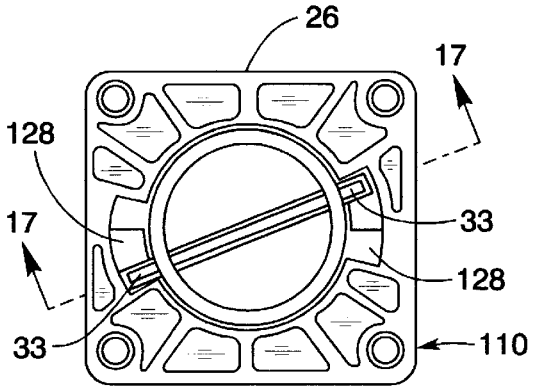
FIG. 16 is a bottom view of the receptor and individual base member section as an assembly.
Figure 17:
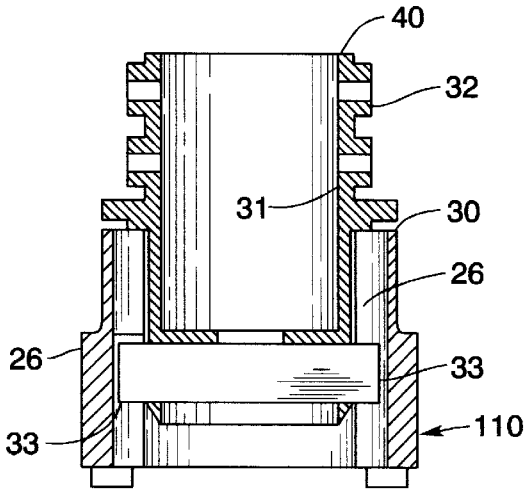
FIG. 17 is a longitudinal cross sectional view taken on line 17—17 of FIG. 16 showing the receptor in a tubular member.

As shown in FIGS. 11, 12 and 14, receptor 32 has internal fins 28 that are attached to the inner periphery of receptor 32 extending from upper end 40 to internal flange 41. Fins 28 engage exercise device 12 or support posts of other exercising equipment. Mounting holes 42 and mounting slots 39 can also engage exercising devices or support structures of other exercising devices. Mounting slot reinforcements 44 provide extra strength in highly stressed areas of receptor 32.

Figure 18:
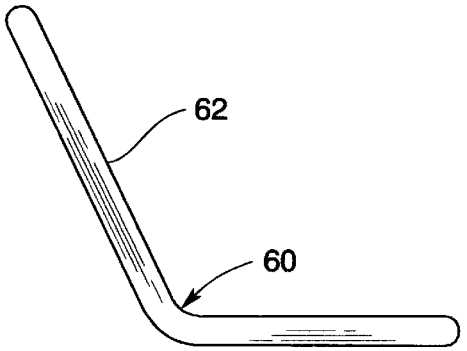
FIG. 18 is a side view of a wrench for removing receptors from the base sections.
Figure 19:
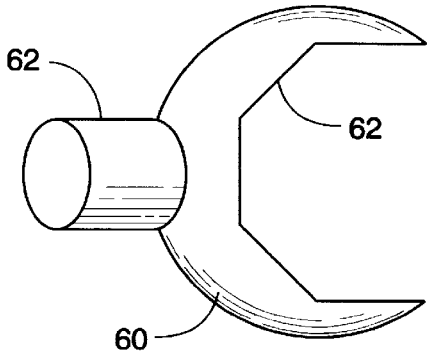
FIG. 19 is a top view of the wrench shown in FIG. 26.

Tool 60, shown in FIGS. 18 and 19, can be used to rotate and remove receptors 32 from base member 11 by a person located above water top surface 22. Tool 60 has handle 62, which is long enough to conveniently reach above water top surface 22. A hexagonal surface 62, of tool 60, can be lowered over hexagonal flange 35 or into receptor 32 to rotate receptor 32 and bring lugs 33 out of horizontal slot 28 so receptor 32 can then be pulled out of tubular members 24.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A base member for use on a flat surface for supporting aquatic exercise equipment or other fastener uses comprising;

a tubular member adapted to receive a receptor member;

said receptor member being attached to an end of an exercise device;

said tubular member having an upper end, a lower end, a generally cylindrical side wall having an inner periphery and an outer periphery;

a support member having a relatively flat top having a hole therein;

said lower end of said tubular members being supported on and integrally attached to said flat top and over said hole; and, said upper end of said tubular member being disposed in a plane generally parallel to said flat top and support means for supporting said support member;

said tubular member has a vertically extending slot in said side wall for receiving a radially outwardly extending lug on said receptor member whereby said receptor member is received in said tubular member to support said aquatic exercise device in an exercise position;

said lug being received in said vertically extending slot and adapted to rotatably move into a horizontally extending slot and against a stop member to hold said receptor from withdrawal from said tubular member.

2. The base member recited in claim 1 wherein said flat top has a plurality of holes;

a plurality of tubes supported around said holes, each of said tubular members has at least one vertically extending slot in each said side wall;

a horizontally extending slot extending from the lower end of each vertically extending slot; a stop member at the other end of each horizontally extending slot.

3. The base member recited in claim 2 wherein each of said tubular members has a second vertically extending slot in said side wall diametrically opposite said first mentioned slot;

said tubular members each having a second horizontally. extending slot connected to said second vertically extending slot; and, said receptor has a second lug adapted to be slidably received in said second vertically extending slot and movable along said vertically extending slot into said horizontally extending slot and against said stop member whereby said receptor is retained in said tubular member.

4. The base member recited in claim 3 wherein channels having spaced legs are attached to said tubular member overlying said vertically extending slots and a flange member extending from one said leg to the other said leg forming a U-shaped cover for each said slot.

5. The base member recited in claim 4 wherein a removable tool is provided for rotating said receptor;

said tool has a non-circular surface adapted to engage a second non-circular surface on said receptor whereby said receptor can be rotated to remove said receptor from said slots; and, an elongated handle on said tool to reach said receptor in its mounted position.

6. The base member recited in claim 2 wherein a stop member is attached to the under side of said plate-like member adjacent said hole in said plate-like member for engaging said lug and limiting the rotation of said receptor.

7. The base member recited in claim 6 wherein said receptor has a non-circular flange supported on the outer periphery of said cylindrical receptor; and, said flange being adapted to be received in a hollow tool with a non-circular surface for engaging said flange whereby said receptor can be rotated moving said lug to said vertical slot position.

8. The base member recited in claim 7 wherein a tool is provided; and, said tool having a non-circular female member adapted to be received on a non-circular part on said tubular receptor.

9. The base member recited in claim 6 wherein said receptor has a non-circular flange supported on the outer periphery of said cylindrical receptor; and, said flange being adapted to be received in a hollow tool with a non-circular surface whereby said receptor can be rotated for installing and removing said receptor.

10. The base member recited in claim 1 wherein said support member comprises a plate-like member having a flange extending downwardly from and around said plate-like member and attached to said plate-like member; and, said flange being adapted to rest on a supporting surface for supporting said base member.

11. The base member recited in claim 1 wherein said support means for supporting said plate-like member comprises support posts fixed to the underside of said plate-like member and adapted to rest on a supporting surface.

12. The base member recited in claim 1 further comprising a channel adapted to support the base member in a desired position; and, said channel providing a range of adjustment of the position of said base member.

13. A base member for aquatic exercise comprising a plurality of tubular members;

each of said tubular members having an upper end and a lower end;

said upper ends of said tubular members being disposed substantially in a first plane;

a plate-like member having spaced holes; and, said lower ends of said tubular members being integrally attached to and supported on said plate-like member around and concentric to said holes;

each said tubular member has a side wall and a vertically extending slot extending though each said side wall from said upper end to said lower end and through said plate-like member;

a horizontal slot in said side wall connected to said vertically extending slot and extending through said tubular member side wall adjacent said lower end; and, a vertical stop member connected to said horizontal slot.

14. The base member recited in claim 13 wherein each said tubular member has a generally U-shaped channel member that overlies said vertically extending slot;

said channel having spaced legs and a flange connecting said legs; and, said spaced legs being connected to said plate-like member adjacent said slot.

15. The base member recited in claim 13 wherein a tubular receptor having an inner periphery received in said tubular member;

circumferentially spaced axially extending fins on said inner periphery;

circumferentially spaced horizontal and vertical slots extending through the tubular member from outer periphery to the inner periphery;

said tubular receptor is hollow with an open top and a post in said receptor for supporting exercise devices;

said post having means for engaging said fins for holding said post against rotation; and, said post having means for engaging said vertical and horizontal slots.

16. A generally rectangular block like base member having a top surface and a bottom surface;

a tubular member having a hollow cylindrical wall integrally attached to said top surface of said block;

a generally cylindrical hole extending through said tubular member and through said block;

an axially extending slot extending through said cylindrical wall of said tubular member at one side of said hole;

a horizontal slot in said block connected to said axial slot;

means on said block for attaching said block to a support; and, said tubular member being adapted to receive a receptor with a laterally extending lug extending into said vertical slot and moveable into said horizontal slot to hold said receptor in place and attaching means on said block for attaching said block to a base member;

said tubular receptor has an inner periphery and axially extending fins are fixed to said inner periphery for engaging a support post; and, said tubular member has an inner periphery and circumferentially spaced horizontal and vertical slots extending through the tubular member from outer periphery to the inner periphery.

17. A base member for use on a flat surface for supporting aquatic exercise equipment or other fastener uses comprising;

a tubular member adapted to receive an end of an exercise device;

said tubular member having an upper end, a lower end, a generally cylindrical side wall having an inner periphery and an outer periphery;

a support member having a relatively flat top and having a hole therein;

said lower end of said tubular members being supported on and integrally attached to said flat top around said hole; and, said upper end of said tubular member being disposed in a plane generally parallel to said flat top and support means for supporting said support member;

said support member comprises a plate-like member having a flange extending downwardly from and around said plate-like member and attached to said plate-like member; and, said flange being adapted to rest on a supporting surface for supporting said base member.

18. The base member recited in claim 17 wherein a plurality of openings are formed in said plate-like member; and, a plurality of tubular members each supported around said opening in said plate-like member.

19. The base member recited in claim 18 wherein a plurality of said base members are attached together in side by side relation providing a single support base.

20. The base member recited in claim 19 wherein said tool has an elongated handle adapted to extend to the top of a body of water.

21. The base member recited in claim 17 wherein a plurality of said base members are attached together in side by side relation providing a single support base.

22. A base member for use on a flat surface for supporting aquatic exercise equipment or other fastener uses comprising;

a tubular member adapted to receive an end of an exercise device;

said tubular member having an upper end, a lower end, a generally cylindrical side wall having an inner periphery and an outer periphery;

a support member having a relatively flat top and having a hole therein;

said lower end of said tubular members being supported on and integrally attached to said flat top around said hole; and, said upper end of said tubular member being disposed in a plane generally parallel to said flat top and support means for supporting said support member; and, said support means for supporting said plate-like member comprises support posts fixed to the underside of said plate-like member and adapted to rest on a supporting surface.

23. A base member for use on a flat surface for supporting aquatic exercise equipment or other fastener uses comprising;

a tubular member adapted to receive an end of an exercise device;

said tubular member having an upper end, a lower end, a generally cylindrical side wall having an inner periphery and an outer periphery;

a support member having a relatively flat top and having a hole therein;

said lower end of said tubular members being supported on and integrally attached to said flat top around said hole; and, said upper end of said tubular member being disposed in a plane generally parallel to said flat top and support means for supporting said support member;

said base member further comprising a channel adapted to support the base member in a desired position; and, said channel providing a range of adjustment of the position of said base member.

* * * * *